US006300027B1

(12) United States Patent
Chambers et al.

(10) Patent No.: US 6,300,027 B1
(45) Date of Patent: Oct. 9, 2001

(54) LOW SURFACE ENERGY PHOTORECEPTORS

(75) Inventors: John S. Chambers, Rochester; Abukar Wehelie, Webster; Huoy-Jen Yuh, Pittsford; Harold F. Hammond, Webster, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/712,140

(22) Filed: Nov. 15, 2000

(51) Int. Cl.[7] ..... G03G 5/047

(52) U.S. Cl. ..... 430/58.2; 430/66; 430/67; 430/132; 430/133

(58) Field of Search ..... 430/58.1, 58.02, 430/58.35, 66, 132, 133, 67

(56) References Cited

U.S. PATENT DOCUMENTS

| | | | |
|---|---|---|---|
| 3,121,006 | 2/1964 | Middleton et al. . | |
| 3,357,989 | 12/1967 | Byrne et al. . | |
| 3,442,781 | 5/1969 | Weinberger . | |
| 4,286,033 | 8/1981 | Neyhart et al. | 430/60 |
| 4,291,110 | 9/1981 | Lee | 430/60 |
| 4,338,387 | 7/1982 | Hewitt | 430/85 |
| 4,415,639 | 11/1983 | Horgan | 430/64 |
| 4,588,666 | 5/1986 | Stolka et al. | 430/96 |
| 4,647,521 | 3/1987 | Oguchi et al. | 430/66 |
| 4,664,995 | 5/1987 | Horgan et al. | 430/64 |
| 4,675,262 | 6/1987 | Tanaka | 430/945 |
| 4,678,731 | 7/1987 | Yoshizawa et al. | 430/65 |
| 4,713,308 | 12/1987 | Yoshizawa et al. | 430/65 |
| 4,717,637 | 1/1988 | Yoshizawa et al. | 430/65 |
| 4,784,928 | 11/1988 | Kan et al. | 430/126 |
| 4,855,203 | 8/1989 | Badesha et al. | 430/84 |
| 4,869,982 | 9/1989 | Murphy | 430/48 |
| 4,871,634 | 10/1989 | Limburg et al. | 430/73 |
| 5,008,167 | 4/1991 | Yu | 430/63 |
| 5,096,795 | 3/1992 | Yu | 430/60 |
| 5,521,047 | 5/1996 | Yuh et al. | 430/134 |
| 5,679,488 * | 10/1997 | Itami et al. | 430/66 |
| 5,707,767 | 1/1998 | Yu | 430/66 |
| 5,709,974 | 1/1998 | Yuh et al. | 430/66 |
| 5,891,594 | 4/1999 | Yuh et al. | 430/71 |

* cited by examiner

*Primary Examiner*—Janis L. Dote
(74) *Attorney, Agent, or Firm*—Oliff & Berridge, PLC

(57) ABSTRACT

An imaging member includes a substrate, a charge generating layer, and a charge transport layer, wherein an external layer of the imaging member includes hydrophobic silica particles uniformly dispersed therein.

12 Claims, No Drawings

LOW SURFACE ENERGY PHOTORECEPTORS

BACKGROUND OF THE INVENTION

1. Field of Invention

The present invention relates to improved photoreceptor designs for electrostatographic printing devices, particularly photoreceptors having low surface energy, thereby providing extended wear and improved operation. More particularly, the present invention relates to photoreceptors having hydrophobic silica incorporated in the charge transport layer.

2. Description of Related Art

In electrophotography, also known as Xerography, electrophotographic imaging or electrostatographic imaging, the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. The radiation selectively dissipates the charge on the illuminated areas of the photoconductive insulating layer while leaving behind an electrostatic latent image on the non-illuminated areas. This electrostatic latent image may then be developed to form a visible image by depositing finely divided electroscopic marking particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

An electrophotographic imaging member may be provided in a number of forms. For example, the imaging member may be a homogeneous layer of a single material such as vitreous selenium or it may be a composite layer containing a photoconductor and another material. In addition, the imaging member may be layered. Current layered organic imaging members generally have at least a substrate layer and two active layers. These active layers generally include (1) a charge generating layer containing a light-absorbing material, and (2) a charge transport layer containing electron donor molecules. These layers can be in any order, and sometimes can be combined in a single or mixed layer. The substrate layer may be formed from a conductive material. In addition, a conductive layer can be formed on a nonconductive substrate.

The charge generating layer is capable of photogenerating charge and injecting the photogenerated charge into the charge transport layer. For example, U.S. Pat. No. 4,855,203 to Miyaka teaches charge generating layers comprising a resin dispersed pigment. Suitable pigments include photoconductive zinc oxide or cadmium sulfide and organic pigments such as phthalocyanine type pigment, a polycyclic quinone type pigment, a perylene pigment, an azo type pigment and a quinacridone type pigment. Imaging members with perylene charge generating pigments, particularly benzimidazole perylene, show superior performance with extended life.

In the charge transport layer, the electron donor molecules may be in a polymer binder. In this case, the electron donor molecules provide hole or charge transport properties, while the electrically inactive polymer binder provides mechanical properties. Alternatively, the charge transport layer can be made from a charge transporting polymer such as poly(N-vinylcarbazole), polysilylene or polyether carbonate, wherein the charge transport properties are incorporated into the mechanically strong polymer.

Imaging members may also include a charge blocking layer and/or an adhesive layer between the charge generating layer and the conductive layer. In addition, imaging members may contain protective overcoatings. Further, imaging members may include layers to provide special functions such as incoherent reflection of laser light, dot patterns and/or pictorial imaging or subbing layers to provide chemical sealing and/or a smooth coating surface.

As more advanced, higher speed electrophotographic copiers, duplicators and printers have been developed, and as the use of such devices increases in both the home and business environments, degradation of image quality has been encountered during extended cycling. Moreover, complex, highly sophisticated duplicating and printing systems operating at very high speeds have placed stringent requirements upon component parts, including such constraints as narrow operating limits on the photoreceptors. For example, the numerous layers found in many modern photoconductive imaging members must be highly flexible, adhere well to adjacent layers, and exhibit predictable electrical characteristics within narrow operating limits to provide excellent toner images over many thousands of cycles. One type of multilayered photoreceptor that has been employed for use as a belt or as a roller in electrophotographic imaging systems comprises a substrate, a conductive layer, a blocking layer, an adhesive layer, a charge generating layer, a charge transport layer and a conductive ground strip layer adjacent to one edge of the imaging layers. This photoreceptor may also comprise additional layers such as an anti-curl back coating and an optional overcoating layer.

Imaging members are generally exposed to repetitive electrophotographic cycling, which subjects the exposed charge transport layer thereof to abrasion, chemical attack, heat and multiple exposures to light. This repetitive cycling leads to a gradual deterioration in the mechanical and electrical characteristics of the exposed charge transport layer. Attempts have been made to overcome these problems. However, the solution of one problem often leads to additional problems.

U.S. Pat. Nos. 5,096,795 and 5,008,167 disclose electrophotographic imaging devices, where the exposed layer has particles, such as metal oxide particles, homogeneously dispersed therein. The particles provide coefficient of surface contact friction reduction, increased wear resistance, durability against tensile cracking, and improved adhesion of the layers without adversely affecting the optical and electrical properties of the imaging member.

U.S. Pat. No. 5,707,767 discloses an electrophotographic imaging member including a supporting substrate having an electrically conductive surface, a hole blocking layer, an optional adhesive layer, a charge generating layer, a charge transport layer, an optional anticurl back coating, a ground strip layer and an optional overcoating layer. At least one of the charge transport layer, anticurl back coating, ground strip layer and overcoating layer includes silica particle clusters homogeneously distributed in a film forming matrix.

U.S. Pat. No. 4,869,982 discloses an electrophotographic photoreceptor containing a toner release material in a charge transport layer. From about 0.5 to about 20 percent of a toner release agent selected from stearates, silicon oxides and fluorocarbons is incorporated into a charge transport layer.

U. S. Pat. No. 4,784,928 discloses an electrophotographic element having two charge transport layers. An outermost charge transport layer or overcoating may comprise a waxy spreadable solid, stearates, polyolefin waxes, and fluorocarbon polymers such as VYDAX fluorotelomer from du Pont and POLYMIST F5A from Allied Chemical Company.

U.S. Pat. No. 4,664,995 discloses an electrostatographic imaging member utilizing a ground strip. The disclosed ground strip material comprises a film forming binder, conductive particles and microcrystalline silica particles dispersed in the film forming binder, and a reaction product of a bi-functional chemical coupling agent that interacts with both the film forming binder and the microcrystalline silica particles.

U.S. Pat. No. 4,717,637 discloses a microcrystalline silicon barrier layer.

U.S. Pat. Nos. 4,678,731 and 4,713,308 disclose microcrystalline silicon in the photoconductive and barrier layers of a photosensitive member.

U.S. Pat. No. 4,675,262 discloses a charge transport layer containing powders having a different refractive index than that of the charge transport layer excluding the powder material. The powder materials include various metal oxides.

U.S. Pat. No. 4,647,521 discloses the addition of amorphous hydrophobic silica powder to the top layer of a photosensitive member. The silica is of spherical shape and has a size distribution between 10 and 1000 Angstroms. Hydrophobic silica is a synthetic silica having surface silanol (SiOH) groups replaced by hydrophobic organic groups such as —$CH_3$.

SUMMARY OF THE INVENTION

Despite the various known photoreceptor designs, there is a continued need in the art for improved photoreceptor packages. For example, there remains a need in the art for longer-lasting photoreceptors while providing lower cost operating costs. In particular, there is a need in the art for lower operating cost electrostatographic printing devices, where lower costs are derived from improved photoreceptor designs. Such improved photoreceptor designs should include increased wear resistance, i.e., low photoreceptor wear, while still providing improved toner transfer, improved cleaning properties, lower toner adhesion, and the like.

The present invention addresses these and other needs by providing a photoreceptor having a lower surface energy. This lower surface energy provides the benefits of decreased toner adhesion and resultant less aggressive cleaning, improved toner transfer, and increased wear resistance. These benefits are provided by incorporating a hydrophobic fumed silica, preferably having a smooth surface, free of pores, in the charge transport layer, or other external layer of the photoreceptor.

In particular, the present invention provides an imaging member comprising:

a substrate, a charge generating layer, and a charge transport layer, wherein an external layer of said imaging member comprises hydrophobic silica particles uniformly dispersed therein.

The present invention also provides a method for making such an imaging member.

DETAILED DESCRIPTION OF PREFERRED EMBODIMENTS

The present invention relates to imaging members having low surface energy, and to methods of forming such imaging members.

According to embodiments of the present invention, an electrophotographic imaging member is provided, which generally comprises at least a substrate layer, a charge generating layer, and a charge transport layer. The charge generating layer and the charge transport layer can, in embodiments, be combined in a single layer. This imaging member can be employed in an imaging process comprising providing the electrophotographic imaging member, depositing a uniform electrostatic charge on the imaging member with a corona charging device, exposing the imaging member to activating radiation in image configuration to form an electrostatic latent image on the imaging member, developing the electrostatic latent image with electrostatically attractable toner particles to form a toner image, transferring the toner image to a receiving member and repeating the depositing, exposing, developing and transferring steps. These imaging members may be fabricated by any of the various known methods.

In general, electrostatographic imaging members are well known in the art. An electrostatographic imaging member, including the electrostatographic imaging member of the present invention, may be prepared by any of the various suitable techniques, provided that the material being applied as the charge transport or external layer includes the low surface energy imparting materials, described below. Suitable conventional photoreceptor designs that can be modified in accordance with the present invention include, but are not limited to, those described for example in U.S. Pat. Nos. 4,647,521, 4,664,995, 4,675,262, 4,678,731, 4,713,308, 4,717,637, 4,784,928, 4,869,982, 5,008,167, 5,096,795, and 5,707,767, the entire disclosures of which are incorporated herein by reference.

According to the present invention, the charge transport layer, or other external layer, includes a low surface energy imparting material. Typically, a flexible or rigid substrate is provided having an electrically conductive surface. A charge generating layer is then usually applied to the electrically conductive surface. An optional charge blocking layer may be applied to the electrically conductive surface prior to the application of the charge generating layer. If desired, an adhesive layer may be utilized between the charge blocking layer and the charge generating layer. Usually the charge generation layer is applied onto the blocking layer and a charge transport layer is formed on the charge generation layer. However, in some embodiments, the charge transport layer may be applied prior to the charge generation layer.

Preferably, the low surface energy imparting material is a hydrophobic fumed silica (also known as an AEROSIL). Suitable fumed silicas include those marketed by Degussa, Inc. under the tradename AEROSIL, and by Cabot Corporation under the tradename CABOSIL. Preferably, the hydrophobic silica is a surface treated and/or functionalized silica, although other hydrophobic silicas can also be used.

Preferably, in embodiments of the present invention, the hydrophobic silica has an average particle diameter of from about 1 to about 60 nanometers, preferably from about 7 to about 40 nanometers. However, sizes outside these ranges can be used, as desired. In addition, in embodiments, the hydrophobic fumed silica preferably has a smooth surface, and/or a surface that is free of pores.

According to the present invention, any suitable silica can be used in forming the hydrophobic silica. Suitable examples include, for example, AEROSIL R104 or R812s, available from Degussa, Inc., as well as the CABOSIL™ products available from Cabot Corporation.

In embodiments, the silica may be surface treated as necessary to provide the desired degree of hydrophobicity.

Suitable surface treatment agents can include, for example, hydrophobic functional groups such as amino silanes; alkyl silanes; vinyl silanes; alkyl chlorosilanes; alkyl methoxysilanes; alkyl ethoxysilanes; fluorinated (completely or partially) alkyl chlorosilanes; methoxysilanes; ethoxysilanes; siloxanes including cyclic siloxanes, such as phenyl pentamethyl disiloxane, phenethyl pentamethyl disiloxane, methoxypropyl heptamethyl cyclotetrasiloxane, chloropropyl pentamethyl disiloxane, hydroxypropyl pentamethyl disiloxane, octamethyl cyclotetrasiloxane, decamethyl cyclopentasiloxane, decamethyl-cyclopentasiloxane, dodecamethyl-cyclohexasiloxane, and the like; other low surface energy materials, such as fluorinated alkyltrialkoxysilane F8261, available from Silvento Chemie GmbH, Dusseldorf, Germany; mixtures thereof; and the like.

Suitable amino silanes include, but are not limited to, 3-aminopropyl triethoxy silane, (N,N-dimethyl 3-amino) propyl triethoxysilane, N,N-dimethylaminophenyl silane, N-phenyl aminopropyl trimethoxy silane, triethoxy silylpropylethylene diamine, trimethoxy silylpropylethylene diamine, trimethoxy silylpropyldiethylene triamine, N-aminoethyl-3-aminopropyltrimethoxysilane, N-2-aminoethyl-3-aminopropyltrimethoxysilane, N-2-aminoethyl-3-aminopropyltris(ethylethoxy)silane, p-aminophenyl trimethoxysilane, 3-aminopropyldiethylmethylsilane, (N,N'-dimethyl 3-amino)propyltriethoxysilane, 3-aminopropylmethyldiethoxysilane, 3-aminopropyl trimethoxysilane, N-methylaminopropyltriethoxysilane, methyl(2-(3-trimethoxysilylpropylamino)ethylamino)-3-proprionate, (N,N'-dimethyl 3-amino)propyl triethoxysilane, N,N-dimethylaminophenyltriethoxy silane, trimethoxysilylpropyldiethylenetriamine, mixtures thereof and the like.

Suitable vinyl silanes include, but are not limited to, vinylalkoxysilanes such as vinyltrimethoxysilane, methyl vinyldimethoxysilane, dimethylvinylmethoxysilane, dimethyltriethoxysilane, methylvinyldiethoxsilane, dimethylvinylethoxysilane, vinylethyldiethoxysilane, vinyltris(2methoxyethoxy)silane, and the like; vinylacetoxysilanes such as vinylmethyldiacetoxysilane, vinylethyldiacetoxysilane, vinyl triacetoxysilane, and the like; allylkoxysilanes such as allyltrimethyoxysilane, allylmethyldimethoxysilane, allyltriethoxysilane, and the like; divinylalkoxysilanes and divinylacyloxysilanes such as divinyldimethoxysilane, divinyldiethoxysilane, divinyldiacetoxysilane, divinyldiacetoxysilane, and the like; diallylalkoxysilanes such as diallyldimethoxysilane, diallyldiethoxysilane, and the like; diallylacyloxysilanes such as diallylacetoxysilane, diallyldiacetoxysilane, and the like; mixtures thereof, and the like. Also suitable are other ethylenically unsaturated silane monomers such as divinyltetramethylenedisiloxane and divinyltetraethyldisiloxane and the like.

Preferably, the hydrophobic silica should provide the layer in which it is contained, such as the charge transport layer or other external layer, with a water contact angle of at least about 100°. Preferably, the water contact angle is at least 102° or more, preferably at least about 105° or more.

Preferably, in embodiments, the hydrophobic fumed silica has an average particle size of less than about 40 nanometer. More preferably, the hydrophobic fumed silica has an average particle size of less than about 30 nanometer, and even more preferably less than about 20 nanaometers.

Suitable processes for treating silica with silanes are known in the art, and are not described in detail herein. However, a common side-effect of such processes is that they leave traces of acid or base in the resultant treated silica. These traces can cause imaging problems when the photoreceptor is used, in that traces of acid can cause imaging problems when the photoreceptor is used, in that traces of acid can increase charge depletion, and traces of base can increase residual voltage. Accordingly, it is preferred in embodiments that neutral products be used, which are completely or substantially free of traces of residual acid and base. Such products can be obtained, for example, either by selecting the silane treatment method and/or materials to eliminate such undesired acid and base traces, or by subsequently purifying or treating the resultant product, as will be apparent to those skilled in the art. Nevertheless, in embodiments, some trace amounts of acid or base can be tolerated depending, for example, on the magnitude of any resultant imaging defects.

As desired for particular applications, the treated silica can be used to provide varying degrees of surface energy reduction to the imaging member. For example, a lower surface energy can be provided by increasing the hydrophobicity of the surface treating agent. In turn, the hydrophobicity of the surface treatment agent or functional groups can be increased by either increasing the alkyl chain length of the silane used to treat the silica, or by increasing the amount of surface area of the silica that is treated. Likewise, the surface energy of the imaging member can be reduced by increasing the loading of the treated silica in the respective imaging member layer.

In embodiments of the present invention, the silica is preferably included in the respective layer, usually the charge transport layer, in an amount of from about 1 to about 30 percent by weight of the layer. Preferably, the silica is included in an amount of from about 3 to about 20 percent, and more preferably from about 5 to about 15 percent, by weight of the layer.

Furthermore, in embodiments, it is preferred that the hydrophobic silica is dispersed uniformly, or at least substantially so, in the respective layer. Uniform dispersion of the hydrophobic silica helps to assure uniform imaging properties as the layer wears down over use.

The particular construction of an exemplary imaging member will now be described in more detail. However, the following discussion is of only one embodiment, and is not limiting of the invention.

The substrate may be opaque or substantially transparent and may comprise numerous suitable materials having the required mechanical properties. Accordingly, the substrate may comprise a layer of an electrically non-conductive or conductive material such as an inorganic or an organic composition. As electrically non-conducting materials there may be employed various resins known for this purpose including, but not limited to, polyesters, polycarbonates, polyamides, polyurethanes, mixtures thereof, and the like. As electrically conductive materials there may be employed various resins that incorporate conductive particles, including, but not limited to, resins containing an effective amount of carbon black, or metals such as copper, aluminum, nickel, and the like. The substrate can be of either a single layer design, or a multi-layer design including, for example, an electrically insulating layer having an electrically conductive layer applied thereon.

The electrically insulating or conductive substrate is preferably in the form of a rigid cylinder, drum or belt. In the case of the substrate being in the form of a belt, the belt can be seamed or seamless, with a seamless belt being particularly preferred.

The thickness of the substrate layer depends on numerous factors, including strength and rigidity desired and economical considerations. Thus, this layer may be of substantial thickness, for example, about 5000 micrometers or more, or of minimum thickness of less than or equal to about 150 micrometers, or anywhere in between, provided there are no adverse effects on the final electrostatographic device. The surface of the substrate layer is preferably cleaned prior to coating to promote greater adhesion of the deposited coating. Cleaning may be effected by any known process including, for example, by exposing the surface of the substrate layer to plasma discharge, ion bombardment and the like.

The conductive layer may vary in thickness over substantially wide ranges depending on the optical transparency and degree of flexibility desired for the electrostatographic member. Accordingly, for a photoresponsive imaging device having an electrically insulating, transparent cylinder, the thickness of the conductive layer may be between about 10 angstrom units to about 500 angstrom units, and more preferably from about 100 Angstrom units to about 200 angstrom units for an optimum combination of electrical conductivity and light transmission. The conductive layer may be an electrically conductive metal layer formed, for example, on the substrate by any suitable coating technique, such as a vacuum depositing technique. Typical metals include, but are not limited to, aluminum, zirconium, niobium, tantalum, vanadium and hafnium, titanium, nickel, stainless steel, chromium, tungsten, molybdenum, mixtures thereof, and the like. In general, a continuous metal film can be attained on a suitable substrate, e.g. a polyester web substrate such as MYLAR available from E.I. du Pont de Nemours & Co., with magnetron sputtering.

If desired, an alloy of suitable metals may be deposited. Typical metal alloys may contain two or more metals such as zirconium, niobium, tantalum, vanadium and hafnium, titanium, nickel, stainless steel, chromium, tungsten, molybdenum, and the like, and mixtures thereof. Regardless of the technique employed to form the metal layer, a thin layer of metal oxide generally forms on the outer surface of most metals upon exposure to air. Thus, when other layers overlying the metal layer are characterized as "contiguous" (or adjacent or adjoining) layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as a transparent layer for light having a wavelength between about 4000 Angstroms and about 7000 Angstroms or a conductive carbon black dispersed in a plastic binder as an opaque conductive layer. A typical electrical conductivity for conductive layers for electrophotographic imaging members in slow speed copiers is about $10^2$ to $10^3$ ohms/square.

After formation of an electrically conductive surface, a hole blocking layer may optionally be applied thereto for photoreceptors. Generally, electron blocking layers for positively charged photoreceptors allow holes from the imaging surface of the photoreceptor to migrate toward the conductive layer. For negatively charged photoreceptors, the blocking layer allows electrons to migrate toward the conducting layer. Any suitable blocking layer capable of forming an electronic barrier to holes between the adjacent photoconductive layer and the underlying conductive layer may be utilized. The blocking layer may include film forming polymers, such as nylon, epoxy and phenolic resins. The polymeric blocking layer may also contain metal oxide particles, such as titanium dioxide or zinc oxide. The blocking layer may also include, but is not limited to, nitrogen containing siloxanes or nitrogen containing titanium compounds such as trimethoxysilyl propylene diamine, hydrolyzed trimethoxysilyl propyl ethylene diamine, N-beta (aminoethyl) gamma-amino-propyl trimethoxy silane, isopropyl 4-aminobenzene sulfonyl, di(dodecylbenzene sulfonyl)titanate, isopropyl di(4-aminobenzoyl)isostearoyl titanate, isopropyl tri(N-ethylaminoethylamino)titanate, isopropyl trianthranil titanate, isopropyl tri(N,N-dimethylethylamino)titanate, titanium-4-amino benzene sulfonat oxyacetate, titanium 4-aminobenzoate isostearate oxyacetate, $[H_2N(CH_2)_4]CH_3Si(OCH_3)_2$, (gamma-aminobutyl)methyl diethoxysilane, $[H_2N(CH_2)_3]CH_3Si(OCH_3)_2$ (gamma-aminopropyl) methyl diethoxysilane, mixtures thereof, and the like, as disclosed in U.S. Pat. Nos. 4,291,110, 4,338,387, and 4,286,033, the entire disclosures of which are incorporated herein by reference. A preferred blocking layer comprises a reaction product between a hydrolyzed silane and the oxidized surface of a metal ground plane layer. The oxidized surface inherently forms on the outer surface of most metal ground plane layers when exposed to air after deposition.

The blocking layer can be further doped with fillers, such as metal oxides, to improve its functionality. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layers are preferably applied in the form of a dilute solution, with the solvent being removed after deposition of the coating by conventional techniques such as by vacuum, heating and the like.

The blocking layers should be continuous and have a thickness of less than about 15 micrometer because greater thicknesses may lead to undesirably high residual voltage.

An optional adhesive layer may be applied to the hole blocking layer. Any suitable adhesive layer well known in the art may be utilized. Typical adhesive layer materials include, for example, but are not limited to, polyesters, DUPONT 49,000 (available from E. I. dupont de Nemours and Company), VITEL PE100 (available from Goodyear Tire & Rubber), polyurethanes, and the like. Satisfactory results may be achieved with adhesive layer thickness between about 0.05 micrometer (500 angstrom) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

Any suitable photogenerating layer may be applied to the adhesive or blocking layer, which in turn can then be overcoated with a contiguous hole (charge) transport layer as described hereinafter. Examples of typical photogenerating layers include, but are not limited to, inorganic photoconductive particles such as amorphous selenium, trigonal selenium, and selenium alloys selected from the group consisting of selenium-tellurium, selenium-tellurium-arsenic, selenium arsenide and mixtures thereof, and organic photoconductive particles including various phthalocyanine pigment such as the X-form of metal free phthalocyanine described in U.S. Pat. No. 3,357,989, metal phthalocyanines such as vanadyl phthalocyanine and copper phthalocyanine, dibromoanthanthrone, squarylium, quinacridones available from Dupont under the tradename MONASTRAL RED, MONASTRAL VIOLET and MONASTRAL RED Y, VAT ORANGE 1 and VAT ORANGE 3 trade names for dibromo anthanthrone pigments, benzimidazole perylene, perylene pigments as disclosed in U.S. Pat. No. 5,891,594, the entire disclosure of which is incorporated herein by reference, substituted 2,4-diamino-triazines disclosed in U.S. Pat. No. 3,442,781, polynuclear aromatic quinones available from Allied Chemical Corporation under the tradename INDOFAST DOUBLE SCARLET, INDOFAST VIOLET LAKE B, INDOFAST BRILLIANT SCARLET and INDOFAST ORANGE, and the like dispersed in a film forming polymeric binder. Multi-photogenerating layer compositions may be utilized where a photoconductive layer enhances or reduces the properties of the photogenerating layer. Examples of this type of configuration are described in U.S. Pat. No. 4,415,639, the entire disclosure of which is incorporated herein by reference. Other suitable photogenerating materials known in the art may also be utilized, if desired.

Charge generating binder layers comprising particles or layers comprising a photoconductive material such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal free phthalocyanine and selenium tellurium alloys are also preferred because these materials provide the additional benefit of being sensitive to infra-red light.

Any suitable polymeric film forming binder material may be employed as the matrix in the photogenerating binder layer. Typical polymeric film forming materials include, but are not limited to, those described, for example, in U.S. Pat. No. 3,121,006, the entire disclosure of which is incorporated herein by reference. Thus, typical organic polymeric film forming binders include, but are not limited to, thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly (amideimide), styrene-butadiene copolymers, vinylidenechloride-vinylchloride copolymers, vinylacetate-vinylidenechloride copolymers, styrene-alkyd resins, polyvinylcarbazole, mixtures thereof, and the like. These polymers may be block, random or alternating copolymers.

The photogenerating composition or pigment may be present in the resinous binder composition in various amounts. Generally, however, the photogenerating composition or pigment may be present in the resinous binder in an amount of from about 5 percent by volume to about 90 percent by volume of the photogenerating pigment dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment, about 8 percent by volume of the photogenerating pigment is dispersed in about 92 percent by volume of the resinous binder composition.

The photogenerating layer containing photoconductive compositions and/or pigments and the resinous binder material generally ranges in thickness of from about 0.1 micrometer to about 5.0 micrometers, and preferably has a thickness of from about 0.3 micrometer to about 3 micrometers. The photogenerating layer thickness is generally related to binder content. Thus, for example, higher binder content compositions generally require thicker layers for photogeneration. Thickness outside these ranges can be selected providing the objectives of the present invention are achieved.

Any suitable and conventional technique may be utilized to mix and thereafter apply the photogenerating layer coating mixture. Typical application techniques include spraying, dip coating, roll coating, wire wound rod coating, and the like. Drying of the deposited coating may be effected by any suitable conventional technique such as oven drying, infra red radiation drying, air drying and the like.

The electrophotographic imaging member of the present invention generally contains a charge transport layer in addition to the charge generating layer. The charge transport layer comprises any suitable organic polymer or non-polymeric material capable of transporting charge to selectively discharge the surface charge. Charge transporting layers may be formed by any conventional materials and methods, such as the materials and methods disclosed in U.S. Pat. No. 5,521,047 to Yuh et al., the entire disclosure of which is incorporated herein by reference. In addition, the charge transporting layers may be formed as an aromatic diamine dissolved or molecularly dispersed in an electrically inactive polystyrene film forming binder, such as disclosed in U.S. Pat. No. 5,709,974, the entire disclosure of which is incorporated herein by reference.

As described above, the charge transport layer of the present invention, particularly when it is the external layer of the imaging member, also includes a hydrophobic silica. The hydrophobic silica can be suitably mixed with the other components of the charge transport layer for application to the imaging member.

Any suitable and conventional technique may be utilized to mix and thereafter apply the charge transport layer coating mixture to the charge generating layer. Typical application techniques include spraying, dip coating, roll coating, wire wound rod coating, and the like. Preferably, the coating mixture of the transport layer comprises between about 9 percent and about 12 percent by weight binder, between about 27 percent and about 3 percent by weight charge transport material, between about 64 percent and about 85 percent by weight solvent for dip coating applications, and between about 3 and about 20 percent by weight of hydrophobic silica, as described above. Drying of the deposited coating may be effected by any suitable conventional technique such as oven drying, infra-red radiation drying, air drying and the like.

Generally, the thickness of the charge transport layer is between about 10 and about 50 micrometers, but thicknesses outside this range can also be used. The charge transport layer should preferably be an insulator to the extent that the electrostatic charge placed on the charge transport layer is not conducted in the absence of illumination at a rate sufficient to prevent formation and retention of an electrostatic latent image thereon. In general, the ratio of thickness of the charge transport layer to the charge generator layer is preferably maintained from about 2:1 to 200:1 and in some instances as great as 400:1. In other words, the charge transport layer is substantially non-absorbing to visible light or radiation in the region of intended use but is "active" in that it allows the injection of photogenerated holes from the photoconductive layer, i.e., charge generation layer, and allows these holes to be transported through the active charge transport layer to selectively discharge a surface charge on the surface of the active layer.

An optional overcoat layer may be applied over the charge transport layer. The overcoat layer may comprise, for example, a dihydroxy arylamine dissolved or molecularly dispersed in a polyamide matrix. The overcoat layer may be formed from a coating composition comprising an alcohol soluble film forming polyamide and a dihydroxy arylamine.

In these embodiments, any suitable alcohol soluble polyamide film forming binder capable of forming hydrogen bonds with the hydroxy functional materials may be utilized in the overcoating. The expression "hydrogen bonding " is defined as the attractive force or bridge occurring between the polar hydroxy containing aryl-amine and a hydrogen bonding resin in which the hydrogen atom of the polar hydroxy arylamine is attracted to two unshared electrons of a resin containing polarizable groups. The hydrogen atom is the positive end of one polar molecule and forms a linkage with the electronegative end of the polar molecule. The polyamide utilized in the overcoatings should also have sufficient molecular weight to form a film upon removal of the solvent and also be soluble in alcohol. Generally, the weight average molecular weights of polyamides vary from about 5,000 to about 1,000,000. Since some polyamides absorb water from the ambient atmosphere, its electrical property may vary to some extent with changes in humidity in the absence of a polyhydroxy arylamine charge transporting monomer, the addition of charge transporting polyhydroxy arylamine minimizes these variations. The alcohol soluble polyamide should be capable of dissolving in an alcohol solvent, which also dissolves the hole transporting small molecule having multi hydroxy functional groups. The polyamides polymers required for the overcoatings are characterized by the presence of amide groups, —CONH. Typical polyamides include the various ELVAMIDE resins, which are nylon multipolymer resins, such as alcohol soluble ELVAMIDE and ELVAMIDE TH RESINS. ELVAMIDE resins are available from E. I. Dupont Nemours and Company. Other examples of polyamides include ELVAMIDE 8061, ELVAMIDE 8064, and ELVAMIDE 8023. One class of alcohol soluble polyamide polymer is disclosed in U.S. Pat. No. 5,709,974, the entire disclosure of which is incorporated herein by reference.

The polyamide should also be soluble in the alcohol solvents employed. Typical alcohols in which the polyamide is soluble include, for example, butanol, ethanol, methanol, and the like. Typical alcohol soluble polyamide polymers having methoxy methyl groups attached to the nitrogen atoms of amide groups in the polymer backbone prior to crosslinking include, for example, hole insulating alcohol soluble polyamide film forming polymers include, for example, LUCKAMIDE 5003 from Dai Nippon Ink, Nylon 8 with methylmethoxy pendant groups, CM4000 from Toray Industries, Ltd. and CM8000 from Toray Industries, Ltd., and other N-methoxymethylated polyamides, such as those prepared according to the method described in Sorenson and Campbell "Preparative Methods of Polymer Chemistry" second edition, pg 76, John Wiley & Sons Inc. 1968, and the like, and mixtures thereof. Other polyamides are ELVAMIDES from E. I. Dupont de Nemours & Co. These polyamides can be alcohol soluble, for example, with polar functional groups, such as methoxy, ethoxy and hydroxy groups, pendant from the polymer backbone. These film forming polyamides are also soluble in a solvent to facilitate application by conventional coating techniques. Typical solvents include, for example, butanol, methanol, butyl acetate, ethanol, cyclohexanone, tetrahydrofuran, methyl ethyl ketone, and the like and mixtures thereof.

When the overcoat layer contains only polyamide binder material, the layer tends to absorb moisture from the ambient atmosphere and becomes soft and hazy. This adversely affects the electrical properties, and the sensitivity of the overcoated photoreceptor. To overcome this, the overcoating of this invention also includes a dihydroxy arylamine, as disclosed in U.S. Pat. Nos. 5,709,974, 4,871,634 and 4,588,666, the entire disclosures of which are incorporated herein by reference.

The concentration of the hydroxy arylamine in the overcoat can be between about 2 percent and about 50 percent by weight based on the total weight of the dried overcoat. Preferably, the concentration of the hydroxy arylamine in the overcoat layer is between about 10 percent by weight and about 50 percent by weight based on the total weight of the dried overcoat. When less than about 10 percent by weight of hydroxy arylamine is present in the overcoat, a residual voltage may develop with cycling resulting in background problems. If the amount of hydroxy arylamine in the overcoat exceeds about 50 percent by weight based on the total weight of the overcoating layer, crystallization may occur resulting in residual cycle-up. In addition, mechanical properties, abrasive wear properties are negatively impacted.

The thickness of the continuous overcoat layer selected may depend upon the abrasiveness of the charging (e.g., bias charging roll), cleaning (e.g., blade or web), development (e.g., brush), transfer (e.g., bias transfer roll), etc., system employed and can range up to about 10 micrometers. A thickness of between about 1 micrometer and about 5 micrometers in thickness is preferred. Any suitable and conventional technique may be utilized to mix and thereafter apply the overcoat layer coating mixture to the charge generating layer. Typical application techniques include spraying, dip coating, roll coating, wire wound rod coating, and the like. Drying of the deposited coating may be effected by any suitable conventional technique such as oven drying, infrared radiation drying, air drying and the like. The dried overcoating of this invention should transport holes during imaging and should not have too high a free carrier concentration. Free carrier concentration in the overcoat increases the dark decay. Preferably the dark decay of the overcoated layer should be the same as that of the unovercoated device.

The photoreceptors of the present invention may comprise, for example, a charge generator layer sandwiched between a conductive surface and a charge transport layer, as described above, or a charge transport layer sandwiched between a conductive surface and a charge generator layer. This structure may be imaged in the conventional xerographic manner, which usually includes charging, optical exposure and development.

Other layers may also be used, such as a conventional electrically conductive ground strip along one edge of the belt or drum in contact with the conductive layer, blocking layer, adhesive layer or charge generating layer to facilitate connection of the electrically conductive layer of the photoreceptor to ground or to an electrical bias. Ground strips are well known and usually comprise conductive particles dispersed in a film forming binder.

In some cases, an anti-curl back coating may be applied to the side opposite the photoreceptor to provide flatness and/or abrasion resistance. These overcoating and anti-curl back coating layers are well known in the art and may comprise thermoplastic organic polymers or inorganic polymers that are electrically insulating or slightly semiconductive. Overcoatings are continuous and generally have a thickness of less than about 10 micrometers.

Any suitable conventional electrophotographic charging, exposure, development, transfer, fixing and cleaning techniques may be utilize to form and develop electrostatic latent images on the imaging member of this invention. Thus, for example, conventional light lens or laser exposure systems may be used to form the electrostatic latent image. The resulting electrostatic latent image may be developed by suitable conventional development techniques such as magnetic brush, cascade, powder cloud, and the like.

While the invention has been described in conjunction with the specific embodiments described above, it is evident that many alternatives, modifications and variations are apparent to those skilled in the art. Accordingly, the preferred embodiments of the invention as set forth above are intended to be illustrative and not limiting. Various changes can be made without departing from the spirit and scope of the invention.

An example is set forth hereinbelow and is illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLES

Example 1

An electrophotographic imaging member is prepared. The imaging member includes a 30 mm diameter honed aluminum substrate, a blocking or undercoating layer, a charge generating layer, and a charge transport layer. The blocking layer is coated using a solution of LUCKAMIDE(a polyamide film forming polymer available from Dai Nippon Ink) in a mixture of methanol, butanol and water, at 55, 36 and 9 parts by weight. The blocking layer is applied at a thickness of 1.0 micrometer, and is dried at 145° C. for 10 minutes. The charge generating layer is coated using a solution of 9.6 parts by weight chlorogallium phthalocyanine (ClGaPC) in 14.4 parts by weight VMCH (available from Union Carbide) in 76 parts by weight of solvent mixture, consisting of 50:50 by weight butyl alcohol:xylene. The charge generating layer is air dried at room temperature. The dried charge generator layer thickness is about 0.2 micrometer. The charge transporting layer is coated using a solution of a mixture of 55 weight % of PCZ400 (a polycarbonate), 36 weight % of (N,N'diphenyl-N,N'-bis(3-methylpropyl)-(1,1'-biphenyl)-4,4'-diamine), and 9 wt. % AEROSIL R104 in 80:20 by weight ratio of tetrahydrofuran:monoclorobenzene solvent mixture. The AEROSIL R104 is a hydrophobic silica having an average particle size of about 12 nm, which is surface treated with octamethyl cyclotetrasiloxane. The charge transport layer solution is mixed for 20 minutes using sonification prior to coating. The charge transporting layer is dried at 118° C. for 45 minutes.

Following completion of the imaging member, the coating appearance of the imaging member charge transfer layer is observed to have a slightly translucent but very uniform appearance. A cross-section of the imaging member shows that the silica is uniformly dispersed in the charge transport layer. The water contact angle on the charge transport layer is measured to be 113°. The PIDC curve for the imaging member is also obtained.

The thus-formed imaging member is also tested for wear in a bench wear fixture with a TR-18 BCR roll (available from Tokai Rubber Co., Japan) and toners. The imaging member shows exceptional wear stability, with more uniform wear on the photoreceptor. The imaging member is also tested in a charge-erase scanner for cycling stability, which shows very stable cycling for 20,000 cycles.

Comparative Example 1

An imaging member, is made following the same procedures and using the same components as in Example 1, except that the surface treated silica is not included in the charge transport layer.

The imaging member is tested using the same tests as in Example 1. The water contact angle on the charge transport layer is measured to be 98°. The PIDC curve for the imaging member is also obtained, and is found to be essentially the same as the PIDC curve for the imaging member of Example 1.

The thus-formed imaging member is also tested for wear in a bench wear fixture with a TR-18 BCR roll. The imaging member shows good wear stability, although the wear is worse (20% more) than in Example 1, and is very non-uniform over the entire photoreceptor than in Example 1. The imaging member is also tested in a motionless scanner for cycling stability, which shows very stable cycling for 20,000 cycles.

Example 2

The same image member is prepared as in Example 1, above, except that AEROSIL R812s is used. The water contact angle is measured to be 109°. The wear and electrical performances are similar to that of Example 1.

Comparative Example 2

The same imaging member is prepared as in Example 1, above, except that acidic AEROSIL R972 is used. The imaging member has a water contact angle of 108°, but it has a 200V charge depletion, as compared to a 50V charge depletion for the imaging member of Example 1 and Example 2.

Comparative Example 3

The same imaging member is prepared as in Example 1, above, except that basic AEROSIL R504 is used. The imaging member has a water contact angle of 109°, but it has a 180V residual voltage, as compare to a 30V residual voltage for the imaging members of Example 1 and Example 2.

What is claimed is:

1. An imaging member comprising:

an electrically conductive substrate, a charge generating layer, and a charge transport layer, wherein an external layer of said imaging member comprises hydrophobic silica particles uniformly dispersed therein, wherein said hydrophobic silica particles are silica particles surface treated with a cyclic siloxane selected from the group consisting of phenyl pentamethyl disiloxane, phenethyl pentamethyl disiloxane, methoxypropyl heptamethyl cyclotetrasiloxane, chloropropyl pentamethyl disiloxane, hydroxypropyl pentamethyl disiloxane, octamethyl cyclotetrasiloxane, decamethyl cyclopentasiloxane, decamethylcyclopentasiloxane, dodecamethyl-cyclohexasiloxane, and mixtures thereof.

2. The imaging member of claim 1, wherein said external layer is said charge transport layer.

3. The imaging member of claim 1, wherein the hydrophobic silica particles have a neutral pH.

4. The imaging member of claim 1, wherein the hydrophobic silica particles are substantially free of trace acids and bases.

5. The imaging member of claim 1, wherein the hydrophobic silica particles are present in an amount of from about 5 to about 15 percent by weight of the external layer.

6. The imaging member of claim 1, wherein the external layer has a water contact angle of at least about 100°.

7. A process for forming an imaging member, comprising:

providing an electrically conducting imaging member substrate, and applying at least a charge generating layer and a charge transport layer to said substrate, wherein an external layer of said imaging member comprises hydrophobic silica particles uniformly dispersed therein, wherein said hydrophobic silica particles are silica particles surface treated with a cyclic siloxane selected from the group consisting of phenyl pentamethyl disiloxane, phenethyl pentamethyl disiloxane, methoxypropyl heptamethyl cyclotetrasiloxane, chloropropyl pentamethyl disiloxane, hydroxypropyl pentamethyl disiloxane, octamethyl cyclotetrasiloxane, decamethyl cyclopentasiloxane, decamethylcyclopentasiloxane, dodecamethyl-cyclohexasiloxane, and mixtures thereof.

8. The process of claim 7, wherein said external layer is said charge transport layer.

9. The process of claim 7, wherein the hydrophobic silica particles have a neutral pH.

10. The process of claim 7, wherein the hydrophobic silica particles are substantially free of trace acids and bases.

11. The process of claim 7, wherein the hydrophobic silica particles are present in an amount of from about 5 to about 15 percent by weight of the external layer.

12. The process of claim 7, wherein the external layer has a water contact angle of at least about 100°.

* * * * *